United States Patent [19]

van Klinken

[11] Patent Number: 4,607,981

[45] Date of Patent: Aug. 26, 1986

[54] METHOD FOR CONSTRUCTING A SCREEN THAT OBSTRUCTS THE FLOW OF SUBSOIL WATER

[75] Inventor: Peter G. van Klinken, Oudenbosch, Netherlands

[73] Assignee: Stevin Construction Inc., Dover, Del.

[21] Appl. No.: 464,960

[22] Filed: Feb. 8, 1983

[30] Foreign Application Priority Data

Feb. 8, 1982 [NL] Netherlands ..... 8200466

[51] Int. Cl.[4] ..... E02D 19/12

[52] U.S. Cl. ..... 405/52; 405/36; 405/258; 405/270

[58] Field of Search ..... 405/38, 109, 114, 267, 405/270, 274, 277, 278, 279, 281, 285, 36, 50, 52, 258, 55, 57

[56] References Cited

U.S. PATENT DOCUMENTS

| | | | |
|---|---|---|---|
| 697,943 | 4/1902 | Jackson | 405/279 |
| 879,792 | 2/1908 | Nye | 405/279 X |
| 929,936 | 8/1909 | Gould | 405/277 |
| 973,821 | 10/1910 | Skinner | 405/114 |
| 1,058,077 | 4/1913 | Luce | 405/109 |
| 1,902,741 | 3/1933 | Weber | 405/114 X |
| 2,863,291 | 12/1958 | Murmann | 405/114 |
| 4,166,508 | 9/1979 | van den Berg | 405/50 X |

FOREIGN PATENT DOCUMENTS

| | | | |
|---|---|---|---|
| 627142 | 5/1963 | Belgium . | |
| 236963 | 7/1911 | Fed. Rep. of Germany | 405/279 |
| 626055 | 2/1936 | Fed. Rep. of Germany | 405/278 |
| 657158 | 2/1938 | Fed. Rep. of Germany . | |
| 2138123 | 2/1973 | Fed. Rep. of Germany . | |
| 2546946 | 4/1977 | Fed. Rep. of Germany . | |
| 630943 | 3/1927 | France . | |
| 869738 | 2/1941 | France . | |
| 1161845 | 3/1958 | France | 405/109 |

*Primary Examiner*—Cornelius J. Husar
*Assistant Examiner*—Nancy J. Stodola

[57] ABSTRACT

Method for constructing a screen that restricts or obstructs the flow of subsoil water in the ground by providing in the ground, from the land level downwardly, subsoil water retaining wall elements that engage each other and are in the shape of wide more or less supple films or sheets, that therefore with their lower edge are releasably connected to a flushing lance that in essense is as wide as each film and said lance after insertion of the film in the ground is released and retracted.

The invention aims to provide a method with which it is possible to construct in a very simple manner a good seal and coupling of the films adjoining each other.

4 Claims, 9 Drawing Figures

METHOD FOR CONSTRUCTING A SCREEN THAT OBSTRUCTS THE FLOW OF SUBSOIL WATER

The invention is related to a method for manufacturing a screen that restricts or obstructs the flow of subsoil water in the ground by providing in the ground from the land level downwardly subsoil water retaining wall elements that engage each other and are in the shape of wide more or less supple films or sheets, that therefor with their lower edge are releasably connected to a flushing lance that in essence is as wide as each film and said lance after insertion of the film in the ground is released and retracted.

Such a method is already proposed in the older not prepublished Netherlands Patent Application 81,04253 corresponding to U.S. Ser. No. 415,803, filed Sept. 8, 1982, corresponding to U.S. Pat. No. 4,484,835.

In this older proposal a great number of possibilities is proposed for mutually sealing the edges of the mutually engaging films. In many cases a curable mass is injected at the edges to obtain a seal.

The invention aims at providing a method with which it is possible to cause in a much more simle manner a good seal and coupling of the films adjoining each other.

According to the invention this aim is obtained by the fact, that the vertical side edges of each previously inserted film is provided with locking profiles connected to the side edges of the film. The profiles are profiled in such a manner that the profile at one side edge of a film can slide in or on the profile of the adjoining side edge of the adjoining film, but the profiles are enclosed in the plane of the films.

Locking profiles are known per se for pile planking. The width of the locking parts of such profiles is substantial in comparison to the width of the planking elements. The planking elements mostly are placed in the ground by means of a ram or vibrating device a fact which also affects the dimension of the locking part. According to the invention the locking profiles have small dimensions, for it is not needed that they take up high loads. They have to be able to catch mutually in a slidable manner after which they are able to support forces in the direction of the film, that forces are higher per running centimeter of the profile then the film connected thereto. The profile therefore is not rammed into the ground but is brought into the ground together with the film whether by the film itself, that indeed is coupled to the flushing lance, or is moved downwardly by the temporary connection to the flushing lance. It remains with the film in the ground possibly after decoupling of the flushing lance.

It is preferred that identical profiles are used that are shaped in such a manner that two profile pieces can be hooked into each other in case one is reversed with regard to the other. The profiles preferably have a length corresponding to the length of the curtain in the ground. Shorter lengths however, are possible in particular in the case of that profile that has to be slit in the profile already present in the ground. A profile part consisting of pieces does not give problems during sliding thrugh a one piece profile.

The profiles preferably have a clamping edge for the film for instance a rim in which the edge of the film with the aid of a wedge or clamping means can be fixed. During bringing the film into the ground it is then possible to gradually couple the advancing film coming from the roll to the profiles.

The inventon now will be elucidated with the aid of the drawings.

Figure 1:
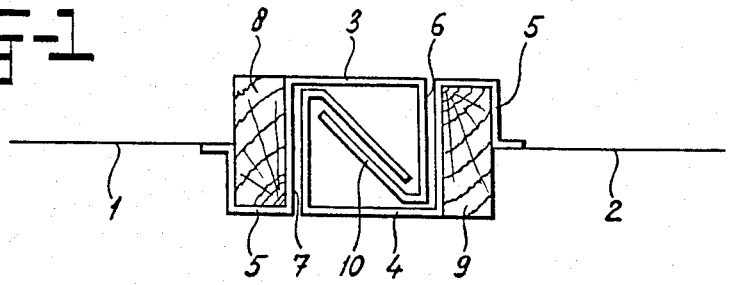
FIG. 1 shows one embodiment of the coupling method according to the invention.

FIG. 1 shows two films 1 and 2 which on the opposed edges that have to be coupled mutually are provided with profiles 3, 4 respectively. The profiles 3 and 4 are identical in cross section. Each profile has a small U-shaped part 5 and a large U-shaped part 6, which have a common leg 7. The films 1, 2 respectively are with the aid of wooden strips 8, 9 respectively clamped in the small U-shaped profile 5.

The large U-shaped part has an inwardly directed leg 10 with the aid of which the hook connection is obtained. Such profiles are able to slide mutually in length direction but in the plane of the films 1 and 2 they form a lock.

Figure 2:
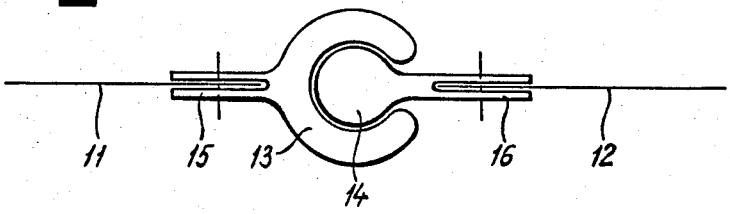
FIG. 2 shows a second embodiment.

FIG. 2 shows films 11 and 12 which with their edges are connected to the lock profiles 13 and 14. The clamping is obtained with the aid of clamping strips 15, 16 that with bolts or such means can be fixed. The profile 13 has a C-shaped cross section and the profile 14 a fitting bead. The dimensions of the profiles shown in FIGS. 1 and 2 can be relatively small certainly in proportion to the width of the film. The cross sections shown in the drawing are of about real dimension.

Figure 3:
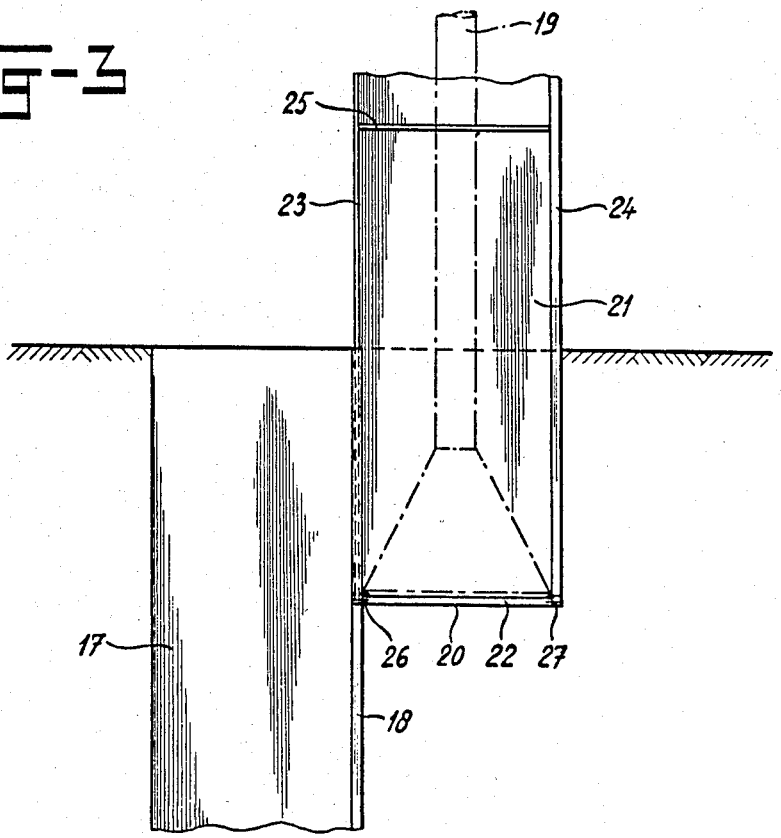
FIG. 3 shows schematically in front view the embodiment of the method according to the invention.
Figure 4:
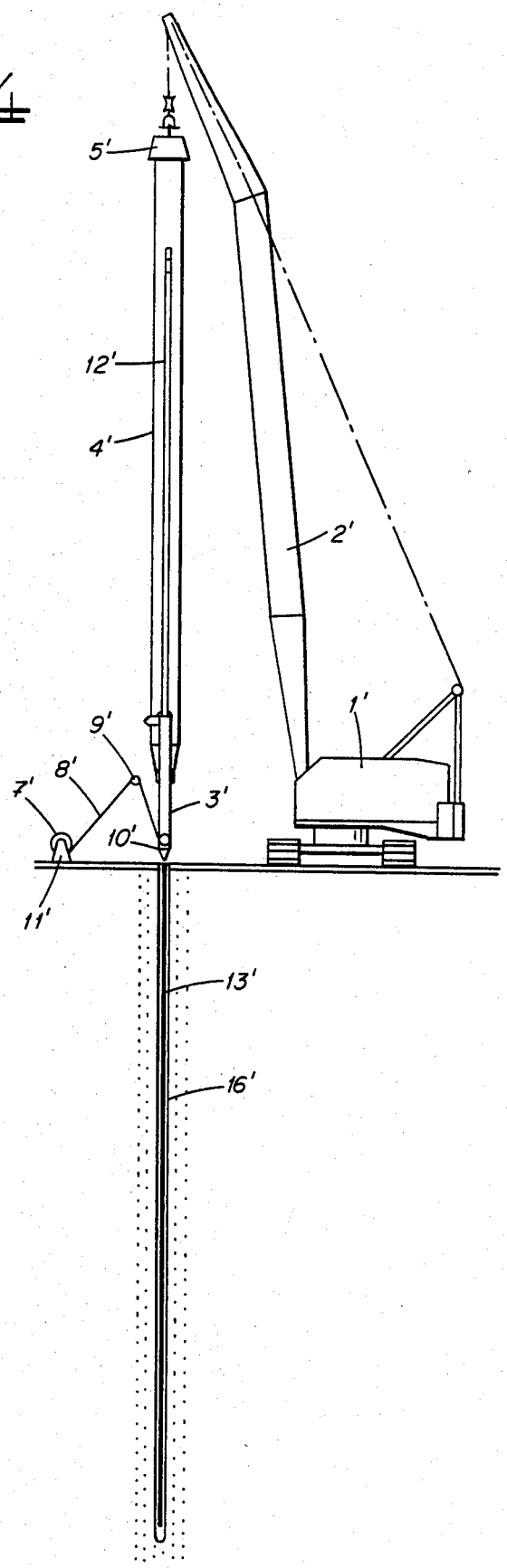
FIG. 4 is a side view of apparatus for manufacturing a ground water barrier.

FIG. 3 shows a film 17 with a profile 18 already inserted in the ground.

Schematically is indicated a flushing lance 19 at the lower edge 20 of which a film 21 with the aid of a clamping strip 22 is connected. To this film profiles 23 and 24 of suitable type are connected, for instance as shown in the FIGS. 1 or 2 and these have a temporary connection 25 on a high positioned spot and a releasable or breakable connection with the flushing lance at the sopt of the lower edge 26 and 27.

After positioning the film or after manufacturing the screen respectively it normally will not be necessary to bring sealing material in the cavities of the profiles. On the film still some tension develops as result of the pressure of the subsoil water by which the profiles itselves abut each other sealingly in some degree. However, the supply of a possibly desired sealing mass is simple, in particular for the profile shown in FIG. 1. The latter has the advantage that the profiles which have to be coupled mutually are identical in cross section. The profile 4 is only reversed with regard to profile 3.

Material Incorporated From Netherlands '253

The above-referenced Netherlands Patent Application 81,04253 contains the following written description as well as FIGS. 4–9 to this application. Prime (') notation is used for part numbers on those drawings to distinguish them from FIGS. 1–3 described above.

For the releasable attachment of the sheet to the lance a lot of solutions are imaginable.

A very simple solution is achieved if the means for attaching the sheet comprise several pins spaced from each other against a side face and directed downwardly from this side face, which pins can cooperate with cloth eyelets in the sheet. These cloth eyelets . . . automatically slide from the pins as soon as the injection lance is retracted upwardly and the sheet is held . . . by . . . suitable means.

Another possibility consists in that the means for attaching of the sheet comprise one or more resilient clamps which while clearing the passage orifices for water, can engage U-like around the lower edge of the lance and to which the sheet is attached and which are provided with outwardly barblike extending resilient tongues, which are inclined upwardly as well as directly away from the legs of the U-shaped clamps if these are in the operating position of the lance. The sheet is fixed with the lower edge in the clamps which are themselves clamped to the lower edge of the injection lance. As soon as the lance is retracted, the resilient tongues acting like barbs remain sticking in the ground and hold the clamps and the sheet. The clamps are but lost in this way.

It is also imaginable that during the injection the lance is several times introduced and retracted before reaching the lowest position. The earlier described arrangements are not suitable for this method.

It will be perfectly clear that a lot of clamping constructions are imaginable which permanently hold the lower edge of the sheet, . . . which clamp constructions can be placed into a position in which the lower edge of the sheet is released by actuating means which extend downwardly along the shaft of the lance. A simple arrangement may comprise a pivoting attachment of the downwardly directed pins, which cooperate with the cloth eyelets of the sheet, at a shaft and form them square or bended such that they can abut the side wall of the lance in a closed position or are moved away therefrom in a disconnecting position, so that the cloth eyelets can move downwardly with respect to the lance.

Figure 5:
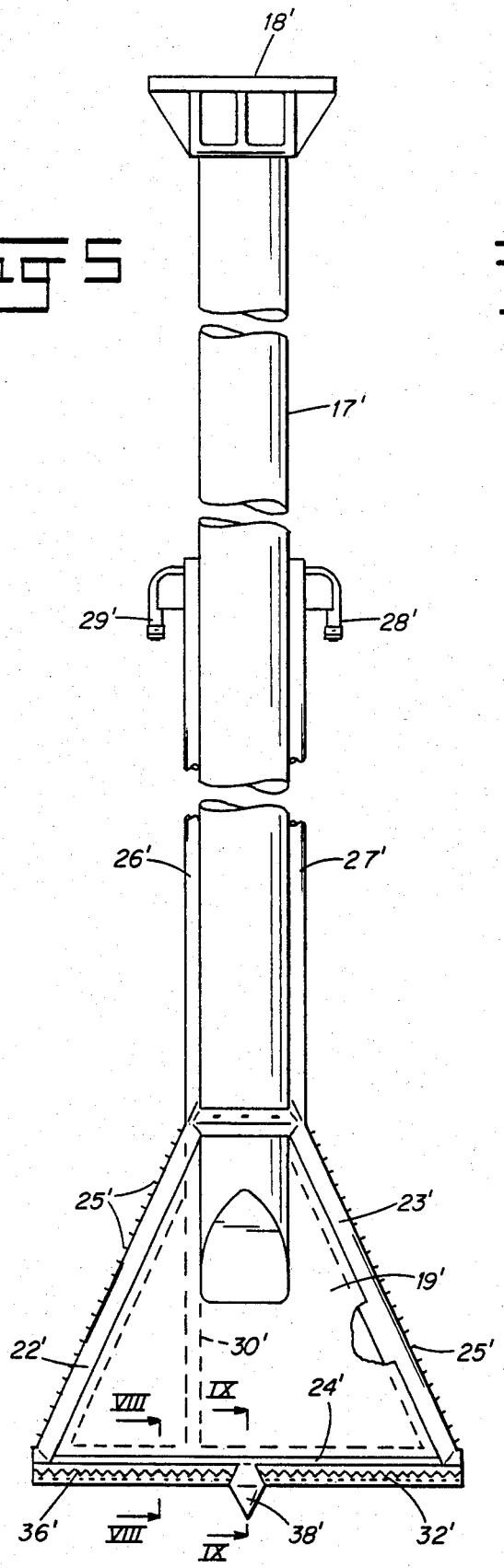
FIG. 5 is a front view of a lance for manufacturing a ground water barrier.
Figure 7:
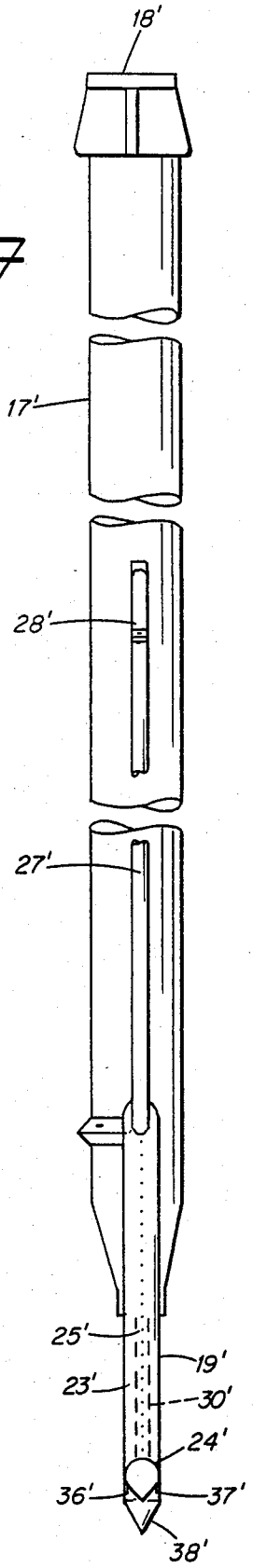
FIG. 7 is a side view of the lance according to FIG. 5.
Figure 6:
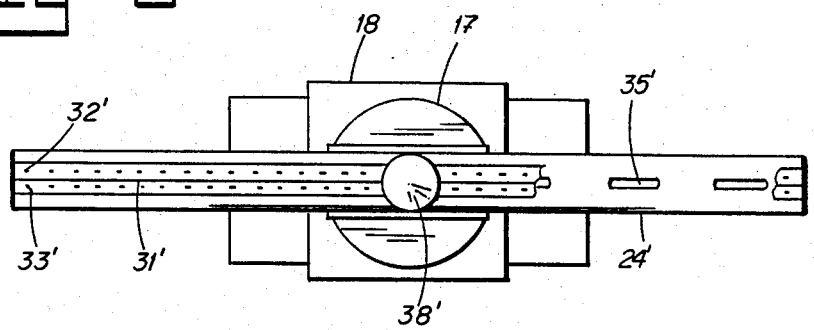
FIG. 6 is a bottom view of the lance according to FIG. 5.

In FIGS. 5, 6, and 7 the arrangement of the lance is shown comprising a tube 17' with head 18'. This tube is at the under end connected to a flat box 19', which is trapezoidal in side view and consists of two parallel walls 20' and 21' (FIGS. 8 and 9), which parallel walls 20' and 21' are welded to the tubes 22', 23', and 24' at the upright side edges and at the lower edge. The upright tubes 22' and 23' have a number of discharging openings schematically shown by the strips 25'. These tubes join supply tubes 26' and 27' which are mounted along the big tube 17' and at which at 28', 29' respectively hoses or flexible lines can be connected. The tubes 22' and 23' are in open communication with the lower tube 24', which can also have a direct supply for instance through tube 30' which is illustrated by dotted lines.

Figure 8:
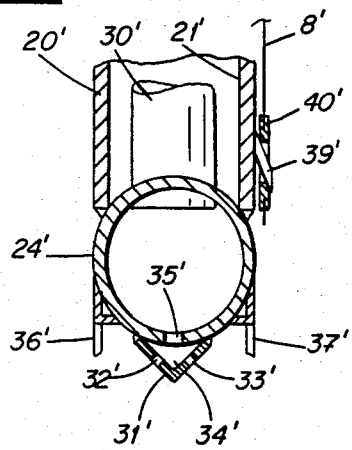
FIG. 8 is a cross-section along line VIII—VIII of FIG. 5 in which a suitable attaching method for the sheet is shown.

In FIG. 8 a downwardly inclined pin 39' is shown, several of which can be mounted distributed across the lower edge of the wall 21' and which stitch into the cloth eyelets 40' of sheet 8. If the injection lance is moved upwardly (indicated at the right hand side in FIG. 8) then the pins 39' withdraw from the eyelets 40'.

Figure 9:
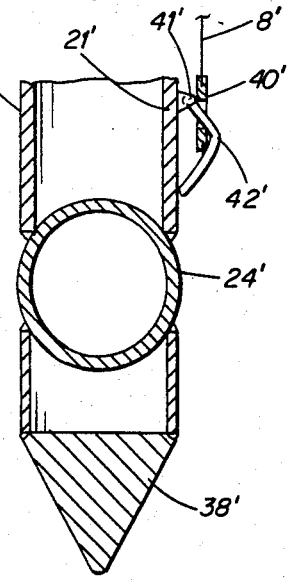
FIG. 9 is a cross-section along line IX—IX of FIG. 5 and shows another attaching method.

FIG. 9 shows another possibility according to which a shaft 41' is rotatably mounted against the side wall 21', on said shaft several hooks 42' are mounted, which can stitch into the cloth eyelets. Counterclockwise rotation of shaft 41' positions the hooks 42' such that the cloth eyelets are released.

I claim:

1. A method of constructing an in-soil water-retention screen comprising at least two webs of supple film material positioned with a longitudinal side edge of a first said web adjacent a longitudinal side edge of a second said web, and a first profile member positioned along said longitudinal side edge of said first web; said first profile member being designed to slide within and cooperate with a second profile member positioned along said longitudinal side edge of said second web, said cooperating profiles having cross sections which are interlocked to resist separation in the direction perpendicular to said profiles and in the plane of said webs, said profiles being sufficiently small to allow insertion of a said profile and a said web together using a flushing lance, said method comprising:

(1) providing a supply roll of web;

(2) unrolling a portion of web from said supply roll and releasably connecting said unrolled web portion to the lower end of a flushing lance comprising downwardly directed water jets and having a width substantially equal to the width of said web;

(3) connecting at least a portion of a first profile member along a longitudinal side edge of said unrolled web portion while simultaneously moving said web and said connected profile with said flushing lance from a first level downwardly into said soil to a desired depth by flushing away soil with said water jets, thereby introducing said first web in the soil;

(4) disconnecting said first web from said lance after reaching the desired depth and raising said lance to said first level; and (5) repeating steps (1) to (4) with said second web to guide said second web with said second profile member attached thereto into the soil with the aid of the flushing lance, and, in so doing, guiding said second profile member into said already inserted first profile member.

2. The method of claim 1 wherin said first profile is releasably connected to said lance before moving the lance into the soil.

3. An in-soil water-retention screen comprising at least two webs of supple film material positioned with a longitudinal side edge of a first said web adjacent a longitudinal side edge of a second said web, said first web comprising, along said longitudinal side edge, a first profile member sized and shaped to slide within and cooperate with a second profile member positioned along said longitudinal side edge of said second web, said cooperating profiles having cross sections which interlock to resist separation in the direction perpendicular to said profiles and in the plane of said webs, each said profile comprising means for connection to a flexible web and being sized and shaped for insertion in the soil together with said web using a flushing lance, at least one said profile member comprising: (1) a U-shaped clamping surface defining, between the legs of the U, an opening; and (2) means for clamping a longitudinal side edge of a said web to said clamping surface positioned in said opening.

4. An in-soil water-retention screen comprising at least two webs of supple film material positioned with a longitudinal side edge of a first said web adjacent a longitudinal side edge of a second said web, said first web comprising, along said longitudinal side edge, a first said profile member sized and shaped to slide within and cooperate with a second said profile member positioned along said longitudinal side edge of said second web, said cooperating profiles having cross sections which interlock to resist separation in the direction perpendicular to said profiles and in the plane of said webs, each said profile comprising means for connection to said flexible web and being sized for insertion in the soil together with said web using a flushing lance, and each said profile comprising:

a first U-shaped member comprising means for clamping a said web edge thereto;

a second U-shaped member sized and shaped to permit sliding passage of a corresponding U-shaped member of an identical profile, said first member and said second member sharing a common leg connecting the base of the first member with the base of the second member, said first member defining an opening which faces in a direction generally opposite to the opening defined by said second member; and a guide member, one end of which is attached to the leg of said second U-shaped member opposite said common leg, said guide member extending from said attachment toward the intersection of said common leg and said base of said second U-shaped member and terminating at a point spaced from said intersection a distance sufficient to allow said sliding passage of said identical profile.

* * * * *